United States Patent [19]

Ford

[11] Patent Number: 4,922,884

[45] Date of Patent: May 8, 1990

[54] HANDHELD WATER BALLOON CATAPULT

[76] Inventor: Jack T. Ford, 7033 Hwy. 290 E. #111, Austin, Tex. 78723

[21] Appl. No.: 324,978

[22] Filed: Mar. 15, 1989

Related U.S. Application Data

[63] Continuation of Ser. No. 57,425, Jun. 2, 1987, abandoned.

[51] Int. Cl.[5] ..... F41B 3/00

[52] U.S. Cl. ..... 124/20.1; 124/41.1

[58] Field of Search ..... 124/20 R, 41 R

[56] References Cited

U.S. PATENT DOCUMENTS

| | | | |
|---|---|---|---|
| 2,735,417 | 2/1956 | Denekar | 124/20 R |
| 3,099,256 | 7/1963 | Halverson | 124/41 R |
| 3,277,878 | 10/1966 | Pankratz | 124/20 R |
| 3,749,075 | 7/1973 | Saunders | 124/20 R |
| 3,802,409 | 4/1974 | Mike et al. | 124/20 R |
| 3,862,626 | 1/1975 | Doherty | 124/41 R |
| 3,875,923 | 4/1975 | Horel | 124/20 R |
| 3,901,209 | 8/1975 | Woolsey et al. | 124/20 R |
| 3,974,820 | 8/1976 | Ott | 124/20 R |
| 4,240,396 | 12/1980 | Randoll | 124/17 |
| 4,250,861 | 2/1981 | Ellenburg | 124/20 R |

FOREIGN PATENT DOCUMENTS

| | | | |
|---|---|---|---|
| 80528 | 4/1963 | France | 124/20 R |

*Primary Examiner*—Edward M. Coven
*Assistant Examiner*—Benjamin Layno
*Attorney, Agent, or Firm*—Pravel, Gambrell, Hewitt, Kimball & Krieger

[57] ABSTRACT

A catapult having traditional slingshot components implementing a yolk of greater clearance, thus allowing an enlarged projectile pouch to be attached. These features allow projectiles, of greater mass such as water balloons, to be launched with considerable accuracy and distance. Combined with the above described catapult is a guard which protects fingers from the occasional contact which may occur during projectile launch.

8 Claims, 3 Drawing Sheets

FIG. 3
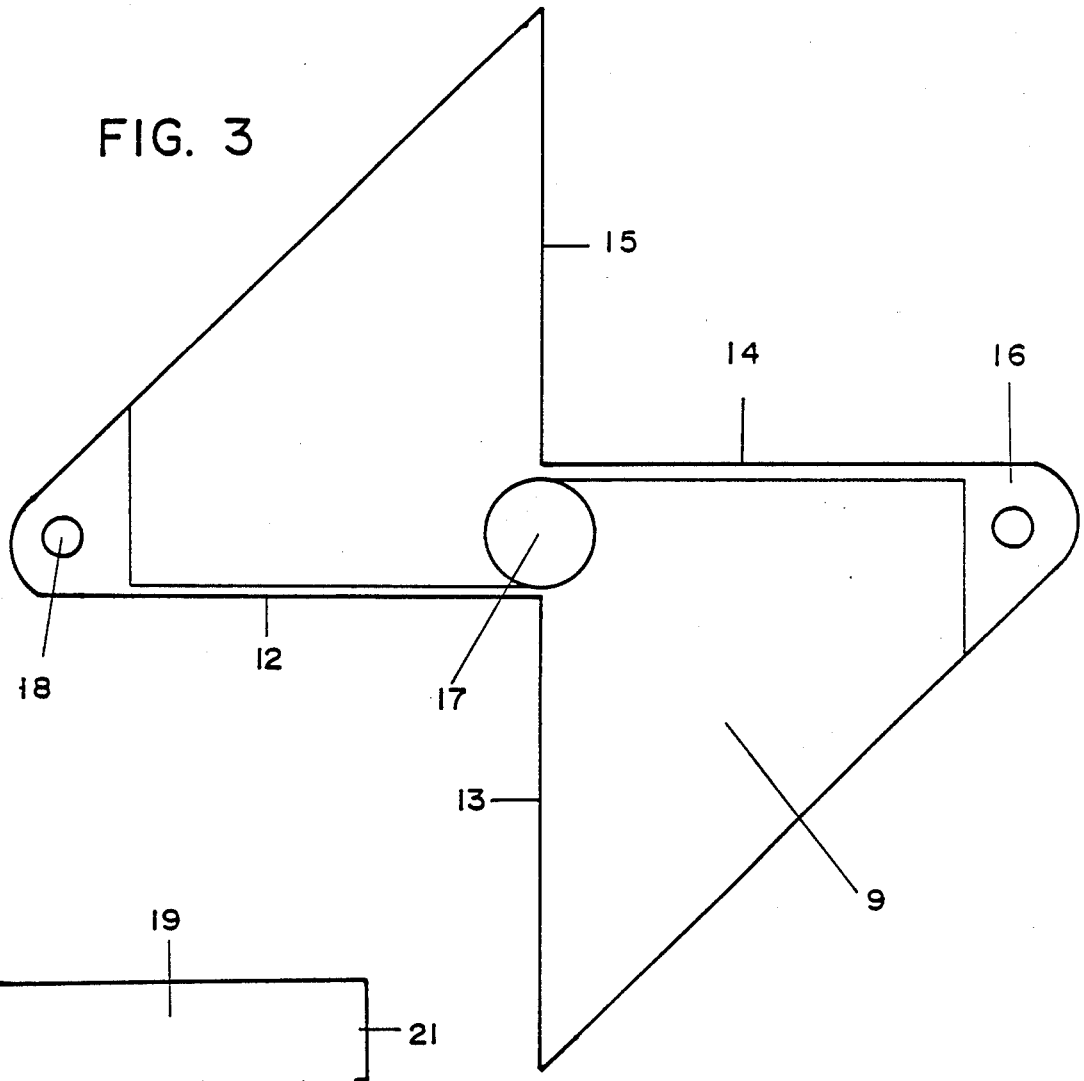
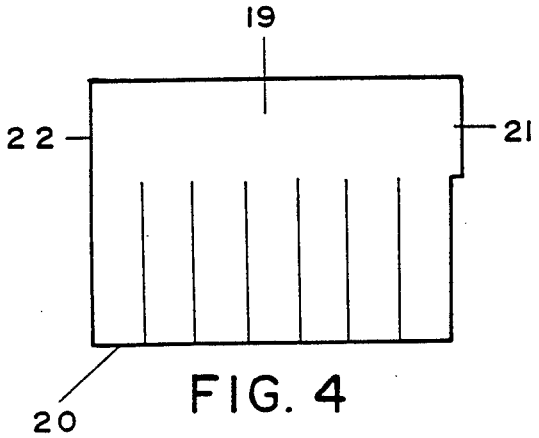
FIG. 4

HANDHELD WATER BALLOON CATAPULT

This is a continuation of co-pending application Ser. No. 057,425 filed on June 2, 1987 now abandoned.

FIELD OF INVENTION

The present invention relates to catapults and more particularly to a handheld catapult, of slingshot design, which is conceived to catapult a large projectile than previously available.

PRIOR ART

The development of the slingshot is one which has been evolving for many years. The first such device was simply a handheld yolk to which was attached an elastic material and a small pouch to hold the missile.

The current slingshot designs are numerous and may contain a variety of bracing devices. These include a simple wrist brace, folding brace, adjustable brace, the removable brace and many alterations thereof.

OBJECTS OF THE INVENTION

It is the object of the present invention to provide a handheld slingshot which is capable of catapulting a projectile of greater mass than previously available.

Another object of the present invention is to provide protection from the occasional contact between the elastic bands or pouch and the user's fingers. This contact often stings and is uncomfortable.

SUMMARY OF INVENTION

The catapult herein disclosed is one which has many applications. The primary objective of the present invention is to provide a handheld catapult to project water balloons. Water balloon wars, being one of America's great summertime activities, will be intensified by the present inventions ability to catapult water balloons a great distance with a considerable amount of accuracy. Many persons, not possessing a good throwing arm, will find that the present invention "Evens The Odds".

Another use for such a catapult is that of hurling sport balls through the air. Catapulting a baseball into the air for fielding practice, using the present invention, is much easier than throwing with the arm. For skeet shooting, a plastic ball may be catapulted to provide a moving target for practice. Still another use is to catapult rubber balls for games or to train dogs to fetch.

The present invention is manufactured similar to the traditional slingshot but contains alterations which will allow larger projectiles to be catapulted. The present day slingshot is comprised of 5 basic elements. These elements begin with the yolk, which is connected to a handle, to which is attached a wrist brace of sorts. Referring back to the yolk, elastic tubes are connected to the ends of the yolk and a pouch is connected to the two elastic tube ends. There are possible additions to this basic format which may include sights, elastic band protectors, and numerous design modifications.

The heart of the present invention is the enlarged projectile pouch and the clearance of the yolk. In addition to the above mentioned features, an optional hand guard is available if desired. The pouch can be fabricated of many materials, including leather, vinyl, plastic, rubber or any other material which can be formed into a "cup" to provide support for projectile during launch. The yolk is extended and widened to provide a plurality of projectile size catapults. The hand guard is a protective option, which may be included with the hand grip portian, to provide hand and finger protection from the elastic bands or the pouch upon release of the projectile.

BRIEF DESCRIPTION OF DRAWINGS

FIG. 3 is an example of a development which is to be formed into a pouch;

FIG. 4 is an example of a development for the projectile handle section of the pouch.

DRAWING REFERENCE NUMERALS

Figure 1:
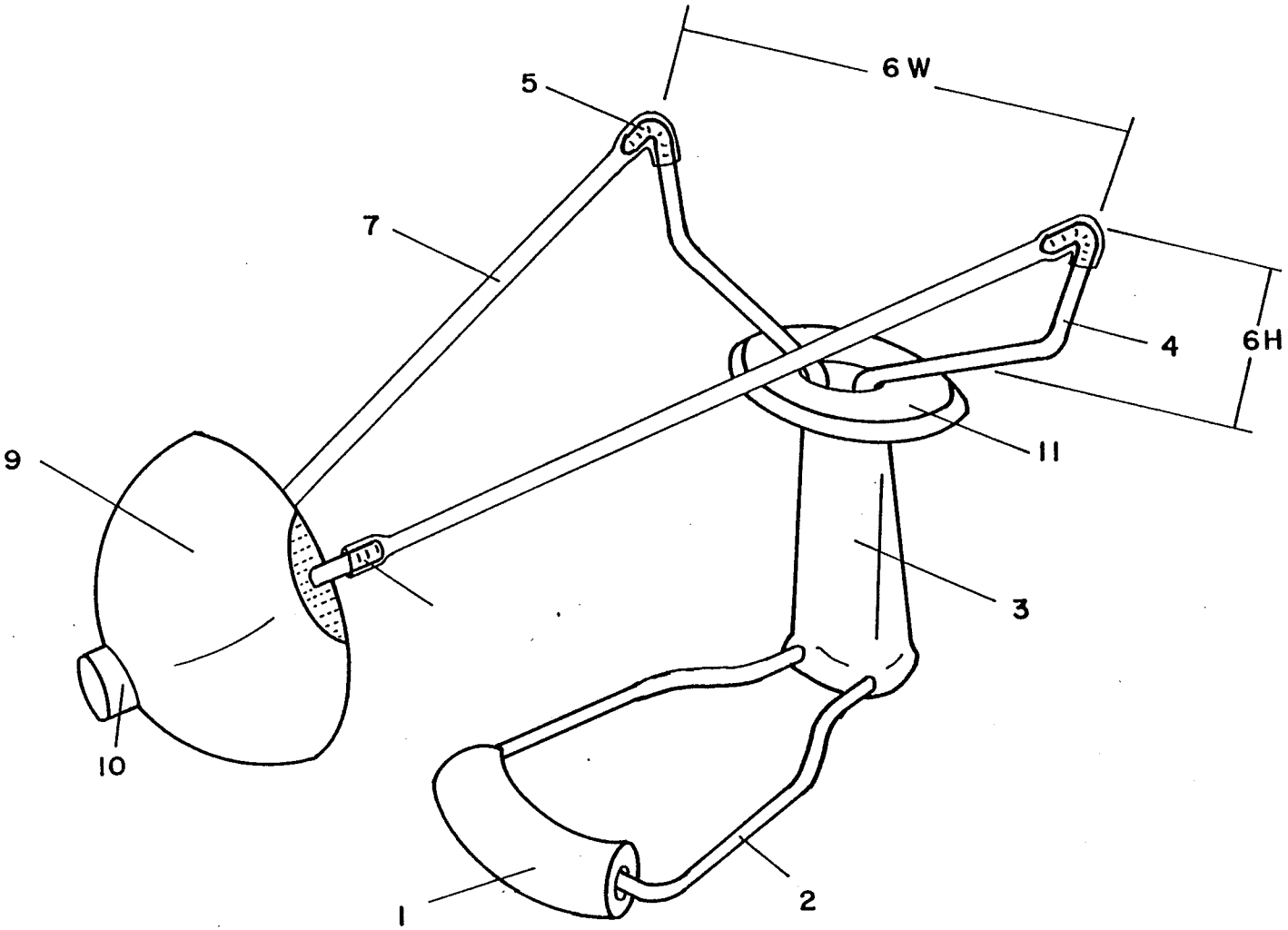
FIG. 1 is a perspective view of the present invention.

1 arm brace cushion
2 arm brace structure
3 hand grip
4 yolk structure
5 ribbed portion of yolk (2)
6 (w) yolk width
6 (h) yolk height
7 elastic bands (2)
8 ribbed plugs (2)
9 projectile pouch
10 projectile handle
11 hand guard (optional)
12 edge (top)*
13 edge (bottom)*
14 edge (top)*
15 edge (bottom)*
16 reinforced junction area (2)
17 orifice
18 eyelets (2)
19 pouch handle
20 handle attaching strips
21 handle edge (top)*
22 handle edge (bottom)*

* 12 sewn to 13/14 sewn to 15/21 sewn to 22

DESCRIPTION OF THE PREFERRED EMBODIMENT

Figure 2:
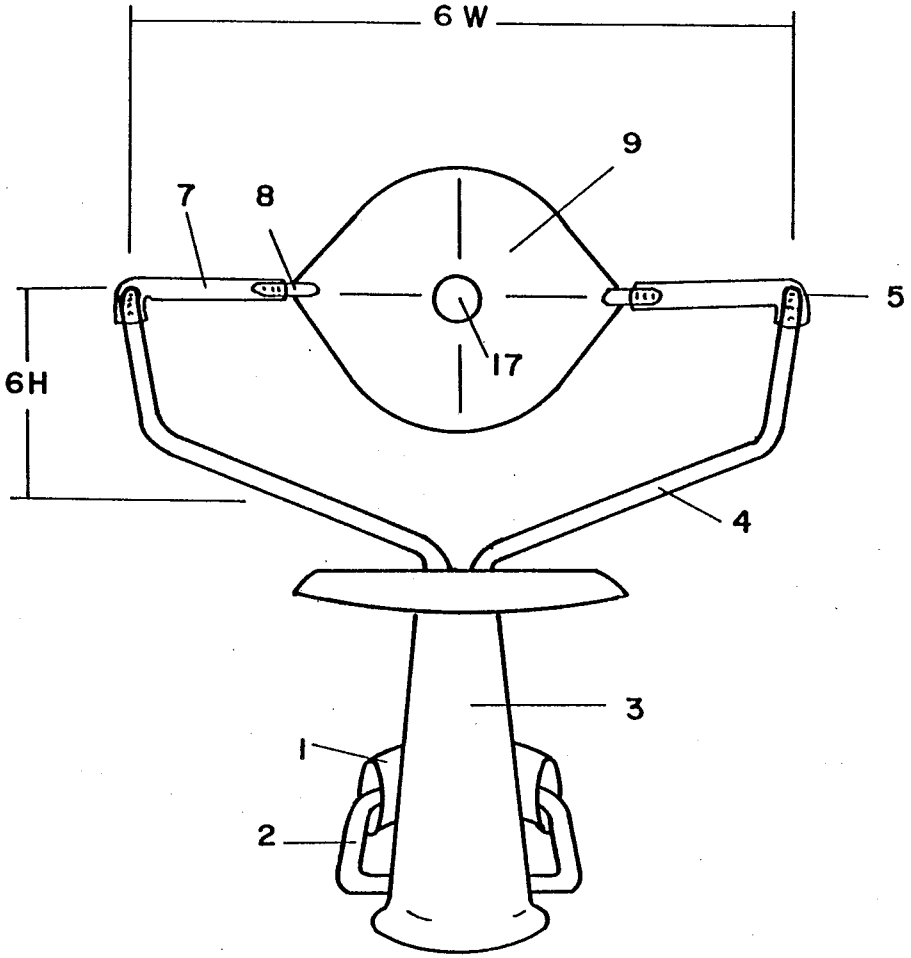
FIG. 2 is a frontal view of the present invention.

Referring now to the drawings and more particularly to FIG. 1 and FIG. 2, the prior known art of wrist supported slingshots is herein described. The arm brace cushion 1 is attached to the arm brace 2 which is connected to the hand grip 3. The preceding is well known for slingshots and is not necessarily a substantial part of the present invention, but is, in one manufacture or another, essential.

The ensuing is one embodiment of the essence of the present invention. The yolk structure 4, being manufactured of most any rigid material such as aluminum, steel, fiberglass, plastic and the like, is specifically designed to provide clearance 6w/6h for the launched projectile. The elastic tubing 7 is held securely by the ribbed portion 5 of the yolk 4. The connection between the elastic tubing 7 and the projectile pouch 9 is obtained by incorporating a ribbed plug 8 which is pulled through the eyelets and inserted into the elastic tube ends. To provide a handle 10 for the pouch 9, an orifice 18 is patterned into the development to allow attachment of pouch handle FIG. 4. Hand protection, from occasional contact between elastic tubes or pouch, is provided by the hand guard 11.

Now referring primarily to FIG. 3, the overlapping edge 12 is sewn onto edge 13 forming a seam. Edge 14 is sewn onto edge 15 thus forming an eliptical pouch to support projectile during launch. The junction area 16 is reinforced by stitching and the eyelets 19 are punched out to form a slot for inserting ribbed plugs 8.

Referring to FIG. 4, the handle can be fabricated by cutting material to proper size and slitted to form sewable strips. After the edge 22 and 21 are sewn together the handle is placed through the orifice 18 and the strips 20 are sewn onto the pouch 9. This type of handle design allows the water balloon "neck" to be inserted and thus providing a securing apperatus for projectile prior to launch.

The illustrations and descriptions are only one representation of many possible embodiments which may perform the functions prescribed for the present invention. The specific terms used in these descriptions are intended simply as one example of many which will perform in a similar manner ot accomplish a similar purpose.

I claim:

1. A catapult device for catapulting a projectile, comprising:

a generally spheroidal projectile requiring an applied force per unit area below a predetermined amount to prevent distortion of the projectile which may cause the projectile to break, the projectile having a density substantially greater than air and the projectile having a basic diameter;

a yoke having two upright portions;

a hand grip connected to said yoke;

a forearm support connected to said hand grip;

two elastic means, each elastic means having two ends, with one end of each of said elastic means being connected to one of said yoke upright portions, each of said elastic means having a size substantially less than said projectile's basic diameter; and pouch means connected to the second end of each of said elastic means, said pouch means adapted and sized to provide support for said projectile and to prevent an applied force per unit area greater than the predetermined amount being applied to said projectile.

2. The catapult device of claim 1, wherein said pouch means has a basic height substantially greater than the size of said elastic means and said pouch means includes means for allowing said pouch means to be gripped by a user's fingers to allow extension of said two elastic means.

3. A catapult device for catapulting a projectile, comprising:

an amorphous and yet generally spheroidal projectile having a density substantially greater than air and having a basic diameter;

a yoke having two upright portions;

a hand grip connected to said yoke;

a forearm support connected to said hand grip;

two elastic means, each elastic means having two ends, with one end of each of said elastic means being connected to one of said yoke upright portions, each of said elastic means having a size substantially less than said projectile's basic diameter; and pouch means connected to the second end of each of said elastic means, said pouch means adapted and sized to provide support for said projectile.

4. The catapult device of claim 3, wherein said pouch means has a basic height substantially greater than the size of said elastic means and said pouch means includes means for allowing said pouch means to be gripped by a user's finger to allow extension of said two elastic means.

5. A catapult device for catapulting a projectile, comprising:

a generally spheroidal projectile having a highly pliant surface, a density substantially greater than air and a basic diameter;

a yoke having two upright portions;

a hand grip connected to said yoke;

a forearm support connected to said hand grip;

two elastic means, each elastic means having two ends, with one end of each of said elastic means being connected to one of said yoke upright portions, each of said elastic means having a size substantially less than said projectile's basic diameter; and pouch means connected to the second end of each of said elastic means, said pouch means adapted and sized to provide support for said projectile.

6. The catapult device of claim 5, wherein said pouch means has a basic height substantially greater than the size of said elastic means and said pouch means includes means for allowing said pouch means to be gripped by a user's fingers to allow extension of said two elastic means.

7. A catapult device for catapulting a projectile, comprising:

a semisolid, generally spheroidal projectile having a a density substantially greater than air and a basic diameter;

a yoke having two upright portions;

a hand grip connected to said yoke;

a forearm support connected to said hand grip;

two elastic means, each elastic means having two ends, with one end of each of said elastic means being connected to one of said yoke upright portions, each of said elastic means having a size substantially less than said projectile's basic diameter; and pouch means connected to the second end of each of said elastic means, said pouch means adapted and sized to provide support for said projectile.

8. The catapult device of claim 7, wherein said pouch means has a basic height substantially greater than the size of said elastic means and said pouch means includes means for allowing said pouch means to be gripped by a user's finger to allow extension of said two elastic means.

* * * * *